US005529573A

United States Patent [19]

Kelly et al.

[11] Patent Number: 5,529,573

[45] Date of Patent: Jun. 25, 1996

[54] PNEUMATIC FLUID ACTUATED CONTINUOUS PASSIVE MOTION DEVICE

[75] Inventors: Kevin A. Kelly, Galloway; Marc D. Taylor, Columbus; Robin L. Taylor, Grove City, all of Ohio

[73] Assignee: Danninger Medical Technology, Inc., Columbus, Ohio

[21] Appl. No.: 152,819

[22] Filed: Nov. 15, 1993

[51] Int. Cl.[6] ..... A61H 1/00

[52] U.S. Cl. ..... 601/34; 601/33

[58] Field of Search ..... 601/5, 24, 26, 601/33, 34, 35, 98, 108; 482/79, 111, 112; 254/93 HP

[56] References Cited

U.S. PATENT DOCUMENTS

| | | | |
|---|---|---|---|
| 3,760,801 | 9/1973 | Borgeas . | |
| 3,884,463 | 5/1975 | Malatesta . | |
| 4,003,374 | 1/1977 | Mizrachy | 601/33 |
| 4,188,677 | 2/1980 | Zur | 5/618 |
| 4,558,692 | 12/1985 | Greiner . | |
| 4,603,687 | 8/1986 | Greenwood | 601/34 |
| 4,629,162 | 12/1986 | Porche . | |
| 4,635,931 | 1/1987 | Brannstam . | |
| 4,665,899 | 5/1987 | Farris et al. . | |
| 4,668,692 | 5/1987 | Noorlander et al. . | |
| 4,786,032 | 11/1988 | Garman et al. . | |
| 4,900,013 | 2/1990 | Rodgers, Jr. | 482/70 |
| 4,930,497 | 6/1990 | Saringer . | |
| 4,967,736 | 11/1990 | Spitzer . | |
| 5,033,457 | 7/1991 | Bonutti | 601/33 |
| 5,040,522 | 8/1991 | Daniels | 601/33 |
| 5,273,520 | 12/1993 | Rebmann | 601/34 |
| 5,320,641 | 6/1994 | Riddle et al. | 601/24 |

FOREIGN PATENT DOCUMENTS

| | | | |
|---|---|---|---|
| 0475735A2 | 3/1992 | European Pat. Off. . | |
| 4011203 | 4/1991 | Germany | 601/33 |
| 961692 | 9/1982 | U.S.S.R. | 601/33 |
| 1319847 | 6/1987 | U.S.S.R. | 601/34 |
| 1579126 | 11/1980 | United Kingdom | 254/93 HP |

*Primary Examiner*—Richard J. Apley
*Assistant Examiner*—Jeanne M. Clark
*Attorney, Agent, or Firm*—Hudak & Shunk Co.

[57] ABSTRACT

A continuous passive motion device comprises a leg support frame actuated by alternately, pneumatically inflating and deflating a bladder assembly. The assembly includes a series of interconnected bladders associated with a pump and a three-way solenoid valve, and provided with flaps secured at a common point which act as a hinge. The secured flaps force movement of the bladders in an arcuate path during inflation and deflation, providing an operating force against pivotal components of the device thus actuating it. A photointerrupter control device is provided that controls the angular limits of the desired therapy.

3 Claims, 5 Drawing Sheets

PNEUMATIC FLUID ACTUATED CONTINUOUS PASSIVE MOTION DEVICE

TECHNICAL FIELD

This invention relates to a continuous passive motion device for providing individuals with recuperative therapy, especially for the legs. More particularly, this invention relates to a continuous passive motion device actuated by pneumatic fluid pressure means, for instance, by variable air pressure. Specifically, this invention relates to a continuous passive motion device having a structural support linkage defining a controlled arcuate motion which is actuated by the alternating inflation and deflation of a plurality of pneumatically interconnected bladder structures adjacently positioned, and hinged together to cause the arcuate motion. In a second embodiment, the invention relates to an apparatus and a method of providing controlled reciprocating angular motion using a photointerrupt circuit.

BACKGROUND OF THE INVENTION

Continuous passive motion applied to an injured limb is a common method of rehabilitative treatment. The devices capable of providing such treatment are typically designed to repetitiously move the limb through a range of positions as medically prescribed. Such machine-applied continuous passive motion promotes the general health and well-being of patients and reduces the time required for rehabilitation.

While devices of the type described are in most cases capable of providing the required rehabilitative therapy, they often involve complex structures that depend upon electrically-driven actuators. Furthermore, the devices usually depend upon mechanical components such as power screws, and the like; components which necessitate relatively close tolerances.

In addition, CPM devices that are dependent upon mechanical interrelationships undergo continual physical stressing that normally results in a high rate of wear-and-tear, and as a consequence, a need for specialized repairs. In addition to their relative complexity and expensive construction, such mechanically driven devices are frequently heavy and therefore cumbersome to transport. Furthermore, they are often associated with operating sounds of the type typically attendant to mechanically-driven devices, sounds that become increasingly objectionable to patients as a consequence of their repetitive nature.

In view of the preceding, it is a first aspect of this invention to provide a continuous passive motion device that does not rely on motor driven mechanical linkages to provide desired physical therapy routines.

A second aspect of this invention is to provide a passive motion device that is less costly to build and to maintain, and that operates relatively quietly.

Another aspect of this invention is to provide a CPM device of relatively simple construction that contains no moving mechanical parts in the drive portion thereof, and one which can therefore be manufactured with less demanding tolerances.

A further aspect of this invention is to provide a CPM device whose simplicity of construction lends itself to modular construction, and therefore to rapid, inexpensive repair, for example, by modular replacements.

An additional aspect of this invention is to provide a continuous passive motion device that is actuated by the application of fluid (either gas or liquid, and preferably air) pressure to the device.

Yet another aspect of this invention is to provide a pneumatic fluid force-generating device, capable of generating an actuating force through the repeated inflation and deflation of adjacent bladders, one part of each of which is anchored at a common hinge point.

Still an additional aspect of this invention is to provide a CPM device having means for controlling the angular positioning between two members which are pivotal with relation to each other, through the interruption of a light beam passing between a light-emitting diode and a phototransistor which forms a part of the device.

BRIEF DESCRIPTION OF THE INVENTION

The foregoing and other aspects of the invention are provided by a continuous passive motion device that includes a movable structural cradle or support which precisely defines the desired motion, and means for actuating the cradle (or support) so as to achieve a preferred CPM therapy. The actuating means includes a plurality of adjacent, inflatable bladders, each of which has walls defining an enclosed space, the spaces communicating with each other. Each bladder also has a flap extending therefrom, the several flaps being secured together at an anchor point. The device further includes pump means to force pneumatic fluid into the bladders, valve means to control the flow of the pneumatic fluid, both such means being connected to the spaces, and control means for controlling the valve means and the pump means. During its functioning, the device alternatingly forces pneumatic fluid into the spaces and allows it to escape therefrom. The bladders responding by alternatingly inflating and deflating. The anchored flaps act as a hinge that causes the bladders to move back and forth in a path about the anchor point, generating an arcuate force that actuates the device.

The foregoing and further aspects of the invention are provided by a device for controlling the angular movement between two objects pivotal relative to each other. The device comprises two optical switches, each including a light-emitting diode member separated from a phototransistor member by a space therebetween, both members extending outwardly from a panel. The panel is movably connected to a first of the objects and has an axial pin extending through the center thereof. Second and third panels are connected to the second of the objects, mounted parallel and adjacent to the first panel with the axial pin also passing through the centers thereof. The latter two panels are rotatable about the axial pin relative to each other, and to the first panel, and each has a photointerrupter wall extending therefrom, the walls being adapted to move through the spaces upon rotation. An indexing means is provided to indicate the position of the second and third panels, relative to the first panel, and the angular position of the objects relative to each other. Circuit means operated by the switches also form part of the device. As the objects change their angular position during operation, the walls are able to interpose themselves in the space between the diode members and the photoresistor members, causing the circuit means to generate electrical signals which control the angular position of the objects relative to each other.

BRIEF DESCRIPTION OF THE DRAWINGS

The invention will be better understood when reference is had to the following figures, in which like-members refer to like-parts, and in which.

DETAILED DESCRIPTION OF THE INVENTION

Figure 1:
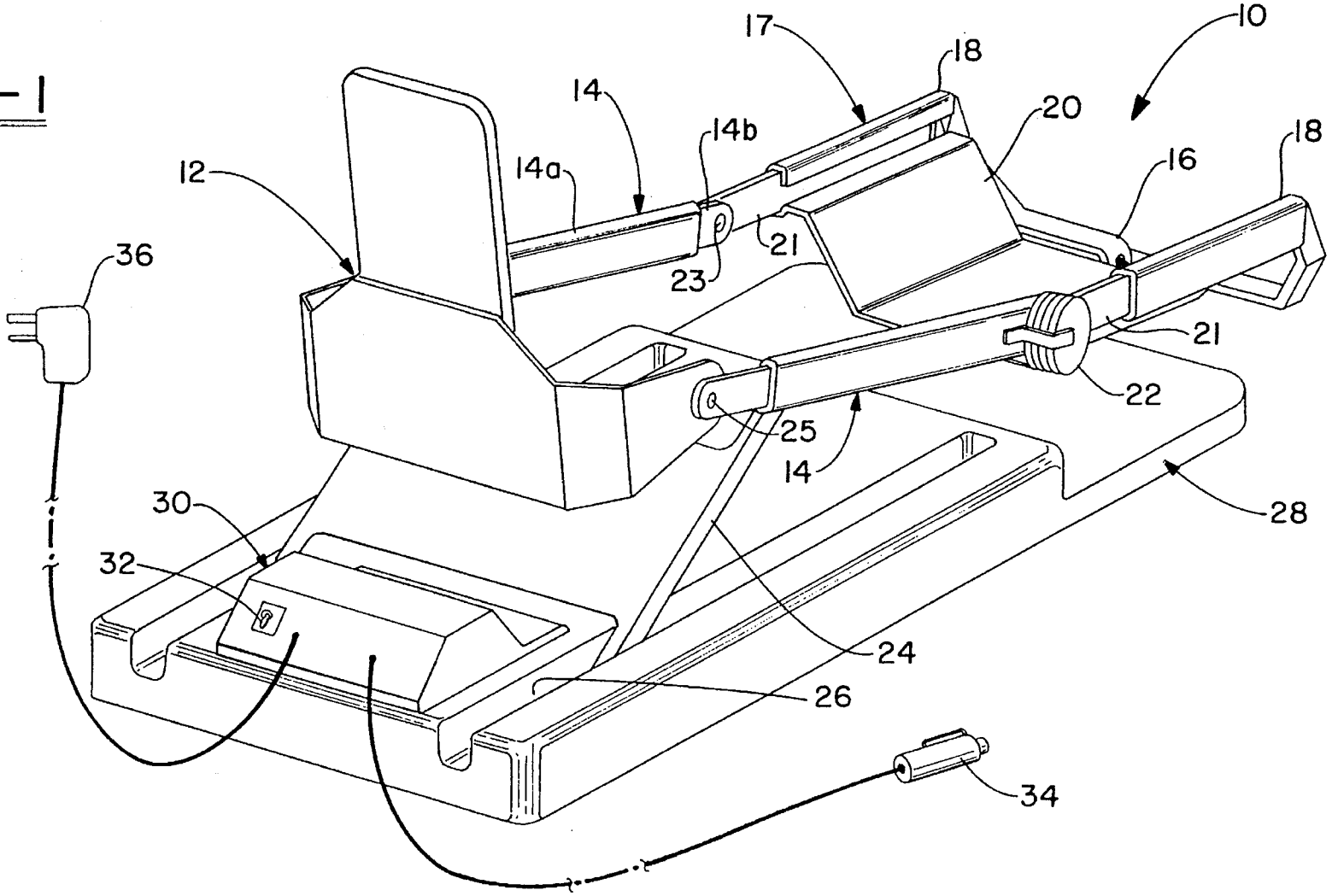
FIG. 1 is an isometric view of the fluid actuated, passive motion device of the invention.

FIG. 1 is an isometric view of the pneumatic fluid-actuated, continuous passive motion ("CPM") device 10 of the invention. The device comprises a base member 28 on which an upper leg bar/pan assembly 17 is pivotally mounted by a lower leg pivot point/bladder clamp assembly 16. The upper leg bar/pan assembly 17 includes an upper leg support pan 20, part of which comprises an upper leg bar sleeve 18 through which upper leg bar 21 is slidably movable in order to adjust the upper leg bar/pan assembly 17 to a length accommodative of the leg of the patient.

The upper leg bar/pan assembly 17 is connected to a lower leg bar assembly 14 at pivot point 23. The lower leg bar assembly 14 comprises a lower leg bar sleeve member 14*a* through which lower leg bar 14*b* is slidably moveable, also to accommodate the anatomy of the patient. Once adjusted, both lower leg bar assembly 14 and upper leg bar/pan assembly 17 can be fixed in position by clamps, screws or other means.

Lower leg support pan 12 is pivotally connected to lower leg support bar assembly 14 at pivot point 25, and is physically dimensioned to receive a foot of the patient.

Also pivotally connected to lower leg bar assembly 14 is a follower member 24, one end of which is captured by, and free to move within the length of follower track 26, for example, supported on wheels. The follower member 24 provides positional integrity to the device during its motion, as explained in connection with operation of the device.

Also included in the device is a pump box 30 which includes a pneumatic pump, a three-way solenoid valve and associated circuitry. An actuation switch 32 is provided to turn the device on and off. A patient pendant 234 is also provided to allow the patient to turn the device on and off while undergoing therapy.

Power is furnished to the CPM device through wall transforming 36, and the range of motion, ROM, is adjusted through the angular motion control device 22.

Therapy is initiated by positioning the patient in a horizontal position with buttocks adjacent to the lower leg bar pivot point/bladder clamp assembly 16. The patient's upper leg is then positioned in upper leg support pan 20, while the lower leg, specifically the foot, is supported by lower leg support pan 12. Actuating pneumatic fluid bladders, better seen in FIG. 1A, placed between base member 28 and upper leg support pan 20, alternately inflate and deflate, causing the upper leg bar/pan assembly 17 to move back and forth in a clockwise/counter-clockwise motion about lower leg bar pivot point/bladder clamp assembly 16. Such movement, in turn, causes lower leg bar assembly 14 to pivot about pivot point 23. The reciprocating movement described alternately causes the leg to undergo flexion and extension in a controlled manner.

The dimensions of the device are not critical to its operation and may be varied within a broad range. For example, the distance between the upper leg bars 21 and between the lower leg bars 14*b* can range from about 8 to 12 inches, while upper leg bar 21 can be telescoped within upper leg support pan 20 to provide an overall length of from about 9 to 15 inches. Similarly, lower leg bar 14*b* can be telescoped within the lower leg bar sleeve 14*a* to provide a length of from about 13 to 17 inches. Adjustment within the ranges described, or within smaller or greater ranges provided, will depend upon the size of the patient. It is envisioned that the device could be used for pediatric as well as for adult therapy.

Figure 2:
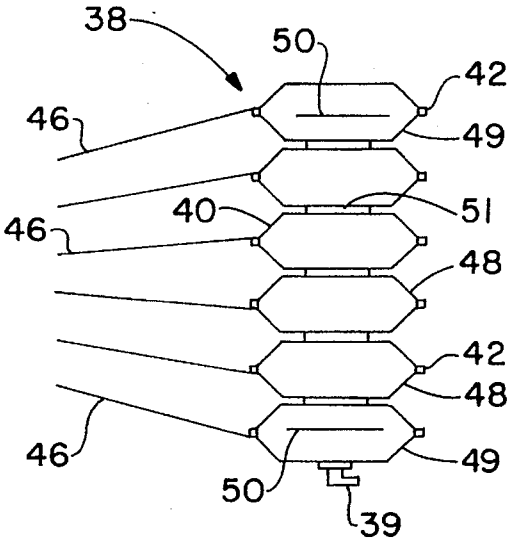
FIG. 2 is an end elevation of a bladder assembly of the invention.
Figure 1A:
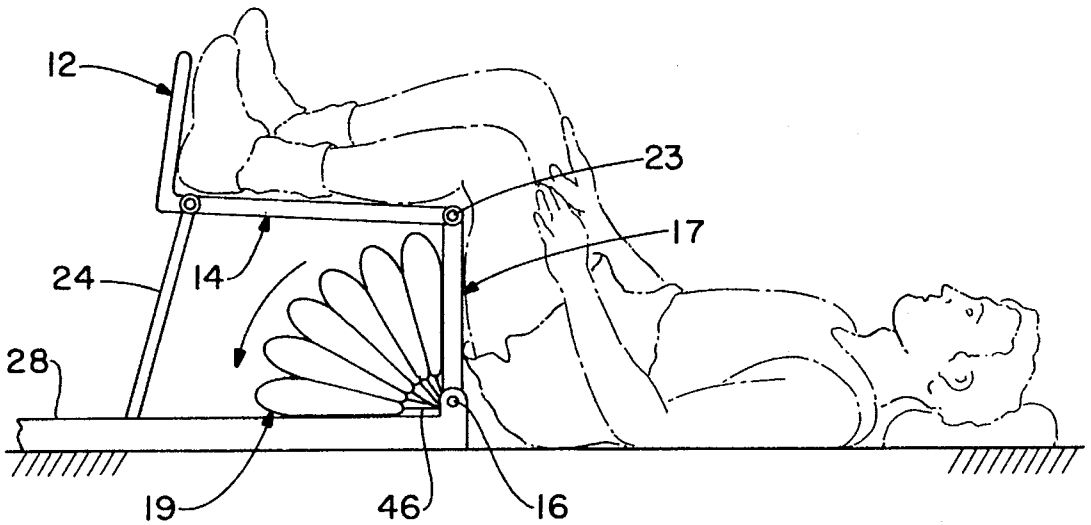
FIG. 1A is a schematic view of a portion of the passive motion device of the invention illustrating the actuating urging of the bladders against components of the device.

FIG. 1A is a schematic view of the invention illustrating the actuating urging of the bladders against the device. As shown, a bladder assembly, generally 19, better seen in FIG. 2 is located between base member 28 and upper leg bar/pan assembly 17, flaps 46 extending therefrom being secured at a common point, for instance at or adjacently to lower leg bar pivot point/bladder clamp assembly 16. The bladder assembly 19 is alternately inflated and deflated, as more particularly described in connection with FIG. 3, causing upper leg bar/pan assembly 17 against which the bladder assembly urges to move back and forth in an arcuate path about lower leg bar pivot point/bladder clamp assembly 16. During such pivoting, lower leg bar assembly 14 also pivots due to its connection at pivot point 23, follower member 24 providing structural stability to both assemblies, i.e., assemblies 14 and 17 during the movement.

In the position illustrated in the Figure, the patient's hip and knee are at a flexion of about 90°. As the bladders are deflated, the force urging upper leg bar/pan assembly 17 lessens, and the weight of the leg causes the assembly to move in a counter-clockwise direction, as shown by the associated arrow to permit extension. If desired, a torsion spring can be provided between base member 28 and upper leg bar/pan assembly 17 to assist in the counter-clockwise pivoting of the upper leg bar/pan assembly 17 during the deflation of the bladder assembly 17.

FIG. 2 is an end view of a bladder assembly of the invention. As shown a plurality of bladders 38 are associated in a bladder assembly, generally 19. Each of the bladders 38 has a hinge flap 46 extending therefrom, which when combined with the balance of the device are secured at a common point where they act as a hinge point for the bladders.

Each of the bladders 38 is comprised of chambers formed from bladder film walls which are assembled together, preferably by thermal welding, although other chemical sealing methods may also be employed. The chambers of each of the bladder units enclose an interior space, all of the interior spaces being in communication with each other through ports 51. One end of the assembly is sealed from the atmosphere, the top bladder 49 as shown in the Figure, while the opposite end 47 is connected to valve means and to a pump as will be later described.

Figure 2B:
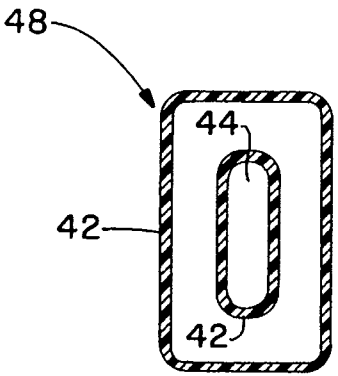
FIG. 2B is a plan view of a B-type bladder film wall.
Figure 2A:
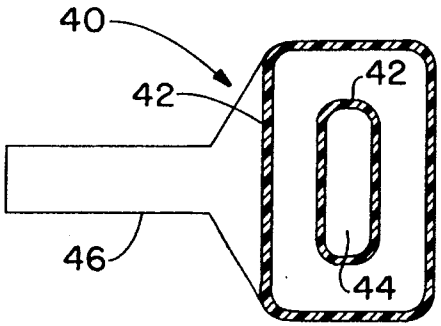
FIG. 2A is a plan view of an A-type bladder film wall.
Figure 2C:
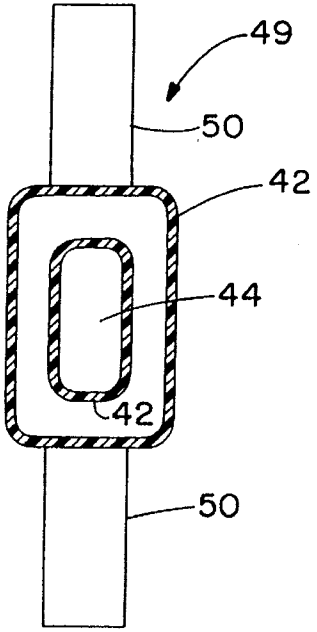
FIG. 2C is a plan view of a C-type bladder film wall.

The bladder units 38 are fabricated from a series of bladder film walls as shown more particularly in FIGS. 2A, 2B, and 2C.

Referring to FIG. 2A, a plan view of an A-type bladder film wall 40 is shown. The film wall has a hinge flap 46 extending therefrom and a cut-out portion which serves as a communicating port 44 located in the center thereof. Both the exterior perimeters of the film wall and the port are connected to adjacent film walls by weldments 42.

FIG. 2B is a plan view of a B-type bladder film wall, generally 48. The film wall 48 also has a cut-out portion 44, serving as a communicating port with adjacent bladders, and again the exterior perimeter of the port and the film wall itself are connected to adjacent bladders by weldments 42.

FIG. 2C is a plan view of a C-type bladder film wall, generally 49. As shown, a cut-out portion 44 is provided on the interior of the film wall 49 and the exterior perimeter of the film wall and the cut-out are secured to a adjacent film walls with weldments 42. In addition, the film wall is provided with two anchor flaps 50, whose purpose is explained in the following.

As will be appreciated from the preceding discussion, one of the notable advantages of the invention is the ability to provide a pneumatically-actuated device that depends upon light-weight, low-cost modular expanding units, i.e., those formed from standardized film walls, as opposed to pneumatic devices that depend upon more expensive, individually shaped expansion units for performing their function.

Referring again to FIG. 2, the sequence of film walls is as shown, the connection between the film walls being provided through weldments 42. In addition, film wall 41 represents an A-type film wall, modified to contain no cut-out portion therein. Likewise, film wall 43 is a modified A-type film wall in which no cut-out port has been provided, but which includes a hole therein for attachment of a connector fitting 39 that communicates with the solenoid valve and pump as later described.

Although the bladder assembly 19 is secured, for example, to the lower leg bar pivot point/bladder clamp assembly 16, by flaps 46, and while the bladder assembly 19 is captured between upper leg bar/pan assembly 17 and base 28, under certain circumstances there is still the possibility of undesirable lateral movement of the bladder assembly. As a consequence, in a preferred mode of the invention, at the top and bottom of the assembly, respectively, C-type film walls are provided whose extending anchor flaps 50 are secured to the frame of the CPM device at suitable points, thereby limiting lateral movement.

The number of the bladders 38 in the bladder assembly 19 can be varied depending upon the amount of angular motion required and the dimensions of the bladders. Typically, about 6 bladder units 38 will be employed. The dimensions of the film walls employed in fabricating the bladder units may be varied within a considerable range, commonly, however, the A-type film walls will have flaps about 2 inches wide by 8 inches long extending therefrom. The width of the film wall will often be about 5½ inches wide by 8½ inches long, while the communicating port 44 will be about 2 inches wide and about 5 inches long. Equivalent portions of the type-B and type-A film walls will be the same; however, the type-B film wall will have anchor flaps 50, commonly about 3 inches wide and 6 inches long. Bladder assemblies fabricated from film walls having the dimensions described will typically have an effective volume of about 8 liters, the angle of maximum expansion of each of 6 such bladders being about 15°, for a total desired range of motion ranging from about −5° to about 110°.

It has been found to be of advantage to fabricate the weldments of such bladders to be about ¼ inch wide. The flaps 46 of the bladders are often secured by means of a clamp, although other means may be employed, and the clamping means may conveniently form part of the pivot point 16, or be adjacent thereto.

While other materials can be used, thermoplastics are particularly desirable, for example, polyester/polyurethane films, from about 5 to about 40 mils with a preferred range being from about 10 to about 25 mils, and most preferably being about 20 mils thick. A suitable range of hardness for the material is from about 70 to about 110, with a preferred range being from about 85 to about 95 on the Shore A scale.

Figure 3:
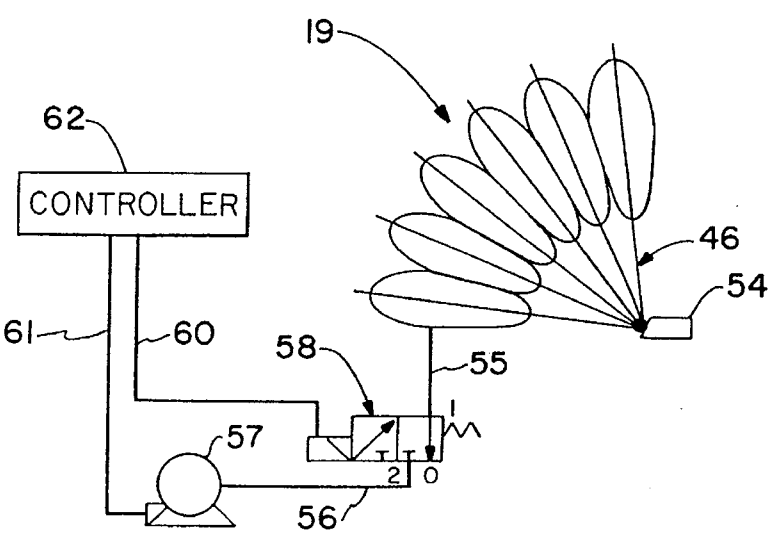
FIG. 3 is a schematic representation of the fluid actuating network of the passive motion device of the invention.

FIG. 3 is a schematic representation of the fluid actuating network of the CPM device of the invention. As illustrated, a bladder assembly 19, the hinge flaps 46 of which are secured by an anchor clamp 54 at a common point, are connected to a fluid connection line 55 which is in turn connected to a solenoid valve 58. Solenoid valve 58 is a three-way valve, connected to pump 57 by fluid connection line 56. Both the solenoid valve 58 and pump 57 are connected by wiring 60 and 61, respectively, to a controller circuit 62.

The three-way solenoid valve 58 is operated so that bladder assembly 19 can be placed in communication either with pump 57 or with the atmosphere.

During operation, specifically during flexion, controller 62 opens solenoid valve 58 so that the bladder assembly is in communication with pump 57, causing the bladders to inflate and flex the patient's leg as better seen in FIG. 1A. At the desired maximum point of flexion, controller 62 shuts off pump 57 and opens solenoid valve 58 to the atmosphere, allowing the bladder assembly 19 to deflate, causing the leg of the patient to undergo extension.

The cycle time for completing translation of the leg extension to flexion and back to extension is about 5 minutes, although faster or slower cycles can be provided for if desired. While the pump capacity can be varied, for instance, from about ½ liter to about 7 liters per minute, when using bladder assemblies of the type described with the dimensions noted, the use of a pump having a capacity of about 2 liters per minute has been found to be desirable.

The range of angular movement of the limb undergoing therapy will be controlled on the basis of the physical condition being addressed; however, it is preferred that the CPM device be controllable between an angular motion of about −5° to about 110°, where 0° represents total extension of the leg. Therapy will normally be controlled within the range of from about 0° to about 90°.

Figure 4A:
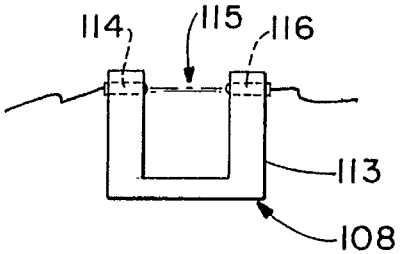
FIG. 4A is an end elevation of a photointerrupter of the invention.
Figure 4:
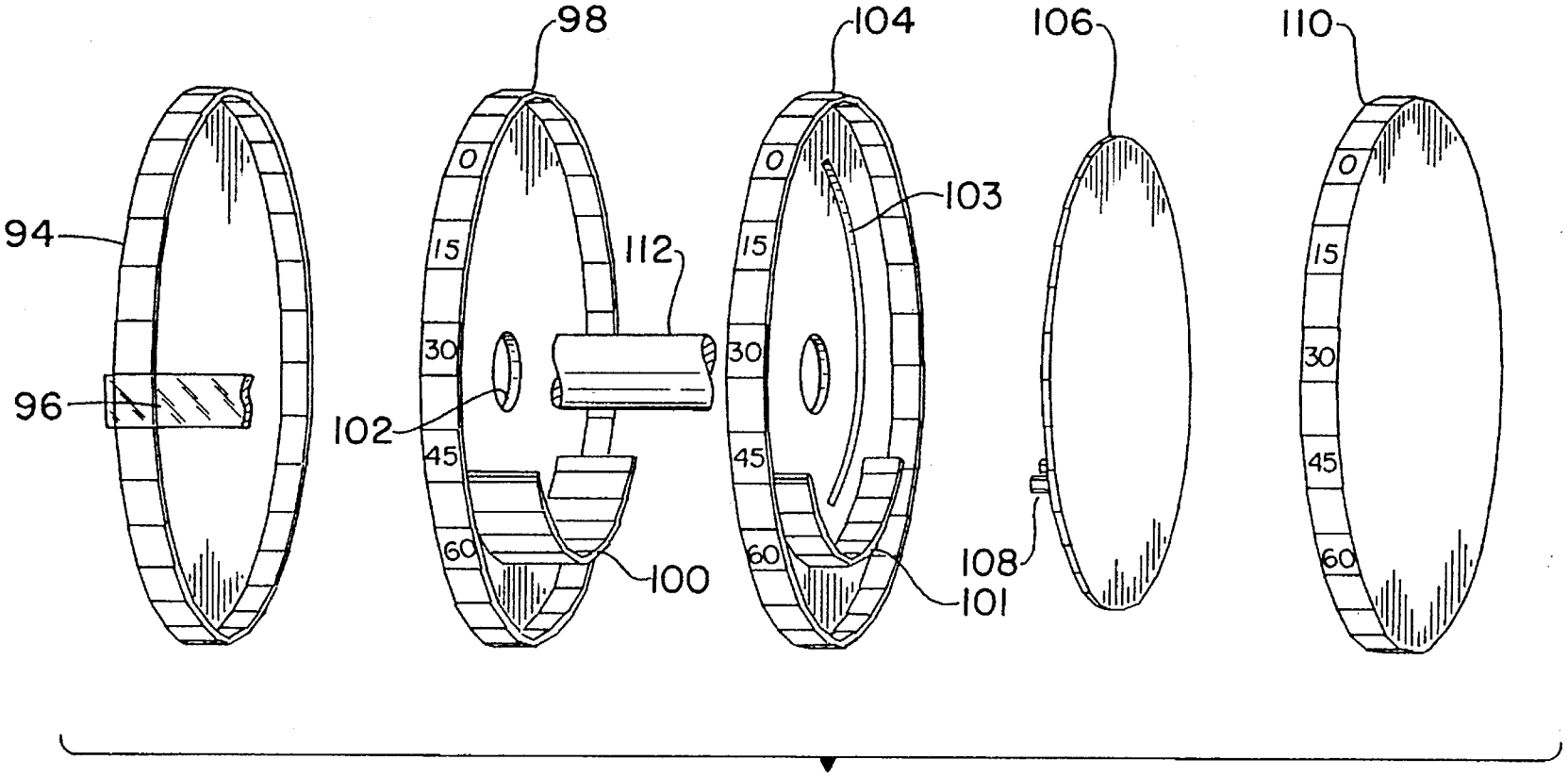
FIG. 4 is an exploded view of the angular movement controller of the invention.

FIG. 4 is an exploded view of a preferred angular movement controller of the invention. Although the CPM device of the invention can be controlled by other devices of the types well-known in the art and different from that of FIG. 4, the controller shown in FIG. 4 provides the advantage of simplicity and reliability, and therefore constitutes a preferred embodiment of the invention. As shown in the Figure, the device consists of a number of rotatable panels, preferably in the form of disks, some of which are rotatable relative to others.

The operative concept of the controller is illustrated in FIG. 4A, which is an end elevation of a photointerrupter switch. In the Figure, a U-shaped yoke 113 includes opposite arms with a gap or space 115 therebetween, which arms respectively mount a light-emitting diode 114 in one arm, and a phototransistor 116 in the other arm. A beam of light emanating from light-emitting diode 114 passes through space 115 and is received by phototransistor 116, the passage therebetween providing a signal to a circuit designed to receive the same. When, however, an object is interposed in space 115, interrupting the light beam, another type of signal is generated, indicating a different condition of the switch. This device is illustrated with a beam of light; however, it should be understood that other wavebeams could be used such as, for example, a magnetic beam or a soundwave.

Referring again to FIG. 4, there is shown an indexing panel 94, with an index window 96 forming a part thereof, and an extension limit panel disk 98 having a axial pin receiving hole 102 in the center thereof. Also shown is a photointerrupter wall 100 mounted outwardly at 90° from the panel, and a flexion limit panel 104, also provided with an axial pin receiving hole 102 and a photointerrupter wall 101 extending outwardly from the panel. The controller includes a printed circuit board 106 provided with two photointerrupters 108, only one of which can be seen in the Figure, and a goniometer panel disk 110.

As mounted, each of the panels described is mounted adjacent and parallel to each other with panels 106 and 110 being unrotatably mounted, for instance, to the upper leg bar 21, while panel 94 is unrotatably mounted, for example, to lower leg bar sleeve 14A. An axial pin 112 extends between the immovable panels; however, it passes through panels 98 and 104 which are rotatable thereabout.

The control is operated by positioning panels 98 and 104, controlling flexion and extension, respectively, at the desired angular limit shown by the calibration on the perimeter of the panels, as seen through index window 96, which is transparent. Springs mounted about axial pin 112, not shown, urge against panels 98 and 104 maintaining them in position once they are rotated to the position desired.

Thereafter, as the angle between lower leg bar assembly 14 and upper leg bar 17 assembly changes during therapy, panels 98 and 104 maintain their position with respect to panel 94, but change position with respect to panels 106 and 110. As this relative change occurs, photointerrupter wall 101 and photointerrupter wall 100, the latter extending through slot 103 of panel 104 periodically intercept the spaces 115 between the two photointerrupters 108 on panel 106. As such interruptions occur, corresponding signals are imposed upon the circuitry which affect operation of the pump and solenoid valve, as previously described, limiting angular movement of the device. The index window is constant with respect to the settings of panels 98 and 104, but changes with respect to panel 110, the latter showing a continuously varying value of angularity between assemblies 14 and 17 as therapeutic movement progresses.

Figure 5:
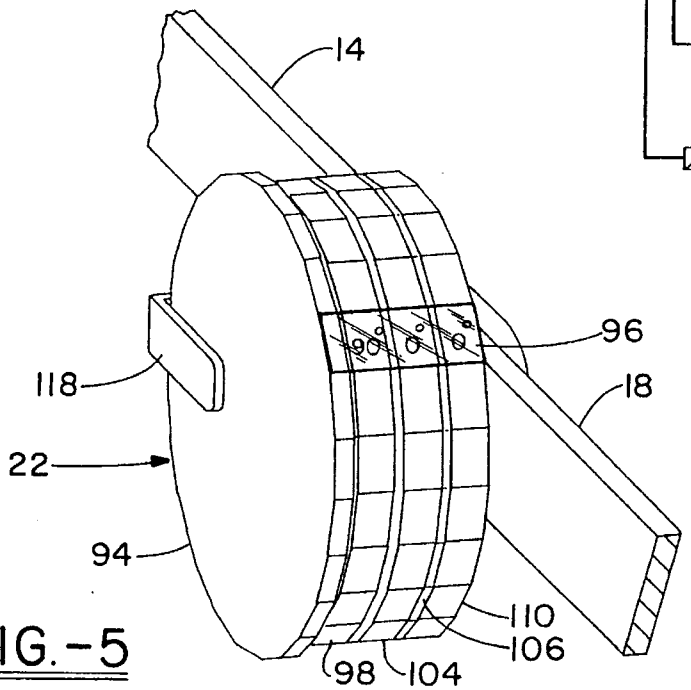
FIG. 5 is an assembled view of the angular movement controller of the invention.

FIG. 5 is an assembly view of the angular movement controller of the invention 22. As shown, panels 94, 98, 104,106 and 110 are mounted in a parallel, adjacent relationship to each other with index window 96 extending from panel 94 across the others. As may be seen, the setting for a flexion of 90°; an extension of 0° and the devices's present position of 0° that is full extension, is shown. Bracket 118 connects panel 94 immovably to lower leg bar assembly 14, while panels 106 and 110 are immovably mounted on upper leg bar sleeve 110. As previously stated, panels 98 and 104 are movable to set limits of flexion and extension as indicated by index window 96, while the index window shows the present position of the CPM device on panel 110.

Figure 6:
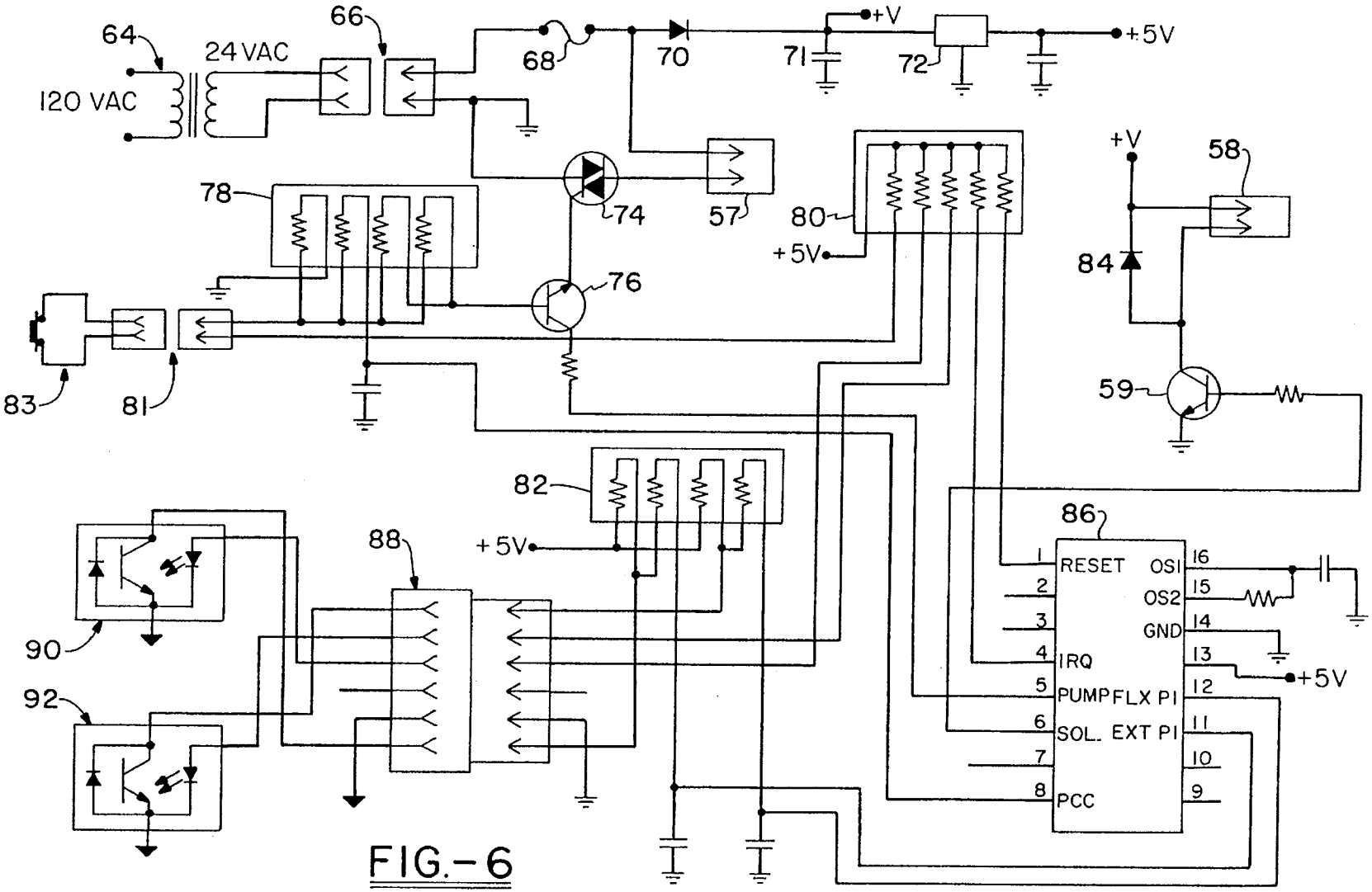
FIG. 6 is a schematic wiring diagram of the invention.

FIG. 6 is a schematic wiring diagram of the invention. While other circuit systems may also be employed, that shown in FIG. 6 represents a preferred embodiment of the invention. As illustrated in the Figure, a wall transformer 64 provides power through connector 66 to the control circuit, which is protected by a fuse 68. Either 110 volt transformer units or 220 volt units can be used for purposes of the invention. The air pump 57 is energized by 24 volt AC current, with the on/off state of the pump being controlled by a triac 74. The non-ground leg of the secondary supplies current through a detector 70 to a diode 72, which half-wave rectifies the voltage. The rectified 24 volt DC is smoothed by a capacitor 71 to provide a voltage V+, the latter voltage being regulated to +5 volts DC by regulator 72. The V+ voltage is used to drive the solenoid 58 (which is in a circuit with detector 84) and for all other functions including powering of the microcontroller 86, for logic levels, and other purposes. When the pin 1 of the microcontroller 86 is held low, e.g., at 0° volts, the microcontroller is held in a reset state. When the device is turned on, the microcontroller 86 begins operation from the reset state. Pin 4 is the IRQ line and is used for external interrupt requests. This line is not used in the circuit, consequently it is tied high by a pull-up resistor 80. Pin 5 is connected to pump 57 and when the microcontroller drives this pin high, the pump is energized, provided the patient pendant 83 has not been activated. If the patient pendant has been activated, the switch opens so as to include the connector 81 and the parallel resistors 78 and the base of the NPN transistor 76 fails to receive current, thus preventing the triac 74 from turning on. This provides a safety feature so that in the event the microcontroller looses control and begins to issue defective instructions, the patient can activate the pendant, stopping the pump 57.

Pin 6 of the microcontroller is connected to the solenoid 58. A high on this pin prevents air in the bladder assembly from exhausting to the atmosphere, while a low on the pin, i.e., no power to the unit, allows air to exhaust to the atmosphere. When pin 6 is high, current flows to the base of NPN transistor 59 which turns on, energizing the solenoid 58. Pin 8 of the microcontroller remains at +5 volts when unactivated; however, upon activation, the following effect is obtained:

| Condition Before | Action | Condition After |
|---|---|---|
| Device Running in Extension | Press Pendant | Stop |
| Stop | Press Pendant | Run in Flexion |
| Device Running in Flexion | Press Pendant | Stop |
| Stop | Press Pendant | Run in Extension |

Pin 11 is the extension photointerrupter input. A high, 5 volts, on this pin indicates that the unit has run to the extension limit and will reverse and run in flexion. Pin 12 operates similarly. In normal operation it is impossible for both of the lines to go high at the same time; however, in the event that this should occur, the unit is stopped.

Pins 13 and 14 supply power to the microcontroller, while pins 15 and 16 are components required for the microcontroller's internal oscillator to function.

To run in flexion, the microcontroller turns the pump on and closes the solenoid valve by energizing it. To run in extension, the microcontroller turns the pump off and opens the solenoid valve by deenergizing it. In stopping the unit, the pump is turned off and the solenoid valve is closed by energizing it.

Extension photointerrupter 90 and flexion photointerrupter 92 are connected to the circuit through connector 88. All NPN transistors are type MPS2222A, while all diodes are type 1N4007.

While the device can be made from a wide variety of materials, it has been found desirable to fabricate the base 28 from plastic-covered foam, and to manufacture the mechanical elements from light-weight, corrosion-resistant metals.

While in accordance with the Patent Statutes, the best mode and preferred embodiment has been set forth, the scope of the invention is not limited thereto, but rather by the scope of the attached claims.

What is claimed is:

1. A continuous passive motion device having a first member pivotably connected to a second member;

an actuator means operatively connected between said first and said second member to cause the angular displacement of the first member relative to the second member;

a controller to control the amount of displacement caused by said actuation means which includes a wave interrupt regulator, said wave interrupt regulator comprising a first marker fixedly attached to said first member;

a second marker fixedly attached to said second support member, said first marker being pivotal with respect to said second marker;

a wall being selectively positionable relative to said first marker and said second marker so as to provide a wave barrier at a selected limit of relative angulation;

and at least one of said first member and said second member including a wave interrupt cell comprising means defining a gap and generating a wave across said gap, whereby said wall is movable to penetrate said gap so as to interrupt said wave; and sensor means which sense when said wave length interrupted by said wall.

2. A device as set forth in claim 1, wherein said first and said second marker each include a wave interrupt cell, and said regulator further includes means to reverse said means to actuate in response to the interruption of said wave.

3. A device as set forth in claim 2, wherein wave is a light wave.

* * * * *